United States Patent [19]

Edwards et al.

[11] 4,240,492

[45] Dec. 23, 1980

[54] PROCESS OF FORMING MULTI PIECE VAPORIZABLE PATTERN FOR FOUNDRY CASTINGS

[75] Inventors: Robert B. Edwards, Niles, Mich.; Theodore D. Jayne, Painesville, Ohio

[73] Assignee: Nibco, Inc., Elkhart, Ind.

[21] Appl. No.: 953,553

[22] Filed: Oct. 23, 1978

[51] Int. Cl.[3] ..... B22C 7/02; B22C 9/04

[52] U.S. Cl. ..... 164/34; 106/38.22; 106/38.28; 164/246

[58] Field of Search ..... 164/25, 34, 246, 360; 106/38.22, 38.27, 38.28; 249/164

[56] References Cited

U.S. PATENT DOCUMENTS

| | | | |
|---|---|---|---|
| 2,120,526 | 6/1938 | Owen | 164/72 |
| 2,180,422 | 11/1939 | Lindsay | 249/164 X |
| 2,509,782 | 5/1950 | Person | 29/464 |
| 2,583,533 | 1/1952 | Hiensch | 164/34 |
| 2,623,809 | 12/1952 | Myers | 29/527.3 |
| 2,830,343 | 4/1958 | Shroyer | 164/34 |
| 3,157,924 | 11/1964 | Smith | 164/34 |
| 3,169,288 | 2/1965 | Dewey | 164/34 |
| 3,302,256 | 2/1967 | Wittmoser | 164/246 |
| 3,339,620 | 9/1967 | Krzyzanowski et al. | 164/24 |
| 3,410,942 | 11/1968 | Bayer | 264/221 |
| 3,443,627 | 5/1969 | Watts | 164/45 |
| 3,452,806 | 7/1969 | Wittmoser | 164/246 |
| 3,496,989 | 2/1970 | Paoli | 164/30 |
| 3,498,365 | 3/1970 | Wittmoser | 164/246 X |
| 3,572,421 | 3/1971 | Mezey et al. | 164/237 |
| 3,675,708 | 7/1972 | Blazek | 164/246 X |

FOREIGN PATENT DOCUMENTS

| | | | |
|---|---|---|---|
| 1089126 | 9/1960 | Fed. Rep. of Germany | 164/246 |
| 1458135 | 9/1970 | Fed. Rep. of Germany | 164/360 |

*Primary Examiner*—Robert D. Baldwin

*Attorney, Agent, or Firm*—Price, Heneveld, Huizenga & Cooper

[57] ABSTRACT

A casting process is disclosed including the steps of fabricating a multi-piece pattern from cellular plastic material, assembling the pieces to form a pattern, coating the pattern with a magnesium silicate ceramic coating and imbedding the pattern in dry, loose sand within a box or flask. The box includes a plurality of perforated side walls and a sprue is connected to the pattern.

12 Claims, 4 Drawing Figures

PROCESS OF FORMING MULTI PIECE VAPORIZABLE PATTERN FOR FOUNDRY CASTINGS

BACKGROUND OF THE INVENTION

The present invention relates to casting processes and more particularly to a casting process employing a vaporizable pattern in a sand mold.

Heretofore, various processes have been proposed for the manufacture of metal components from ferrous and non-ferrous materials. The casting processes heretofore employed to produce relatively detailed structures, such as steel valve bodies, have included the steps of forming a pattern typically from wood to make a mold, packing foundry sand which includes a binder around the pattern in a support box or flask in cope and drag sections. The mold is then split, the pattern is removed and a mold cavity is defined. In the manufacture of structures such as valve bodies which are hollow, the conventional processes have required the formation of cores which are placed within the mold cavity to form the interior surfaces of the casting. Molten metal is prepared and poured into the completed mold through a feeding system from transferring ladles.

Another process has been employed to fabricate accurately cast highly alloyed steels which are difficult if not impossible to forge and, at best, very difficult to machine. This process is commonly referred to as the lost wax, investment or precision casting process. In this process, wax or plastic patterns are cast in an accurate metal die. The patterns are then thickly coated with a refractory material until an aggregate shell is formed. When the shell is set, the mold is heated and the wax or plastic is drained therefrom. The mold thus formed is supported in loose sand and a metal charge is poured in a conventional manner.

Relatively recently, an additional casting process has been developed which employs a coated vaporizable pattern. The pattern is formed from a cellular plastic material such as polystyrene or polyurethane and has heretofore been coated with a gas permeable refractory material. The coated pattern is then imbedded in dry sand within a support box or flask. A metal charge is poured through a sprue or other gating system. The metal charge vaporizes the pattern upon contact therewith. The combustion gases from the pattern pass through the coating or out through the sprue to be dispersed into atmosphere. Examples of this latter process may be found in U.S. Pat. No. 2,830,343 to Schroyer, entitled CAVITYLESS CASTING MOLD AND METHOD OF MAKING SAME and issued on Apr. 15, 1958 and U.S. Pat. No. 3,572,421 to Mezey et al, entitled AIR BREATHING FLASK FOR FOUNDRY MOLDS and issued on Mar. 23, 1971.

The vaporizable pattern casting processes while reducing the costs associated with the lost wax or investment processes or the more conventional molding processes discussed above, have not been totally acceptable. The primary difficulty with the vaporizable pattern process relates to the quality of the surface of the casting. Present vaporizable pattern processes permit the mold sand to burn into the metal charge thereby severely affecting the quality of the casting. Typical foundry sands and refractory coatings employed are not able to prevent cross fusion of the metal and the sand and still permit the gases generated to pass through the coating.

SUMMARY OF THE INVENTION

In accordance with the present invention an improved casting process of the vaporizable cellular plastic pattern type is provided whereby the problems heretofore experienced with the surface quality of the completed casting are substantially eliminated. Essentially, the process includes the steps of fabricating a plurality of separate cellular plastic pattern pieces, assembling the pieces to form a pattern having the configuration of the item to be cast, coating the pattern with a magnesium silicate coating, imbedding the pattern in dry, loose sand within a flask, connecting a sprue to the pattern and pouring a metal charge into the sprue. The coating employed to coat the assembled pattern permits the escape of gases upon vaporization of the pattern to the surrounding sand, possesses adequate refractory characteristics to withstand exposure to the metal charge without breaking down, thereby precluding cross fusion between the metal and the sand, provides geometric stability for the sand around the coated pattern, is chemically inert at the temperature of the metal charge and is non-reactive with the pattern and non-adherent to the metal charge. Further, the coating is capable of air drying without cracking after application to the pattern.

DETAILED DESCRIPTION OF THE PREFERRED EMBODIMENT

Figure 1:
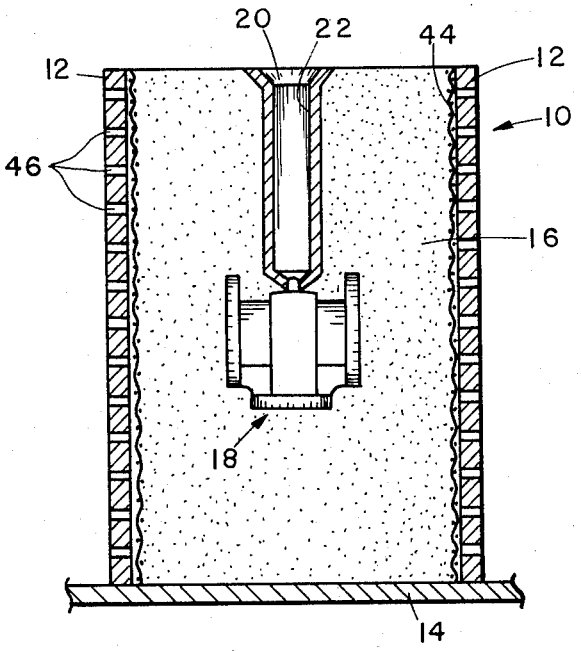
FIG. 1 is a side elevational view partially in section of a mold with a vaporizable pattern imbedded therein.

With reference to the drawings, FIG. 1 illustrates a mold generally designated 10 including a flask or support box having walls 12 and a bottom 10. Imbedded within a dry foundry sand 16 is a vaporizable pattern generally designated 18. A sprue 20 is connected to the pattern. The sprue 20 may be lined with asbestos 22.

Figure 3:
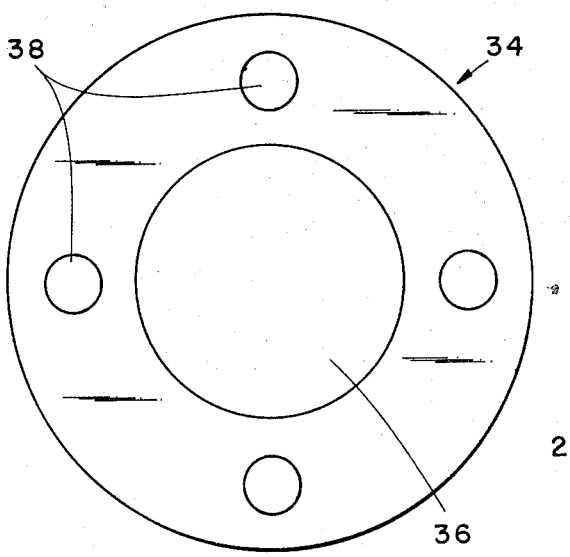
FIG. 3 is an elevational view of another element of the vaporizable pattern for fabrication of a valve body.
Figure 2:
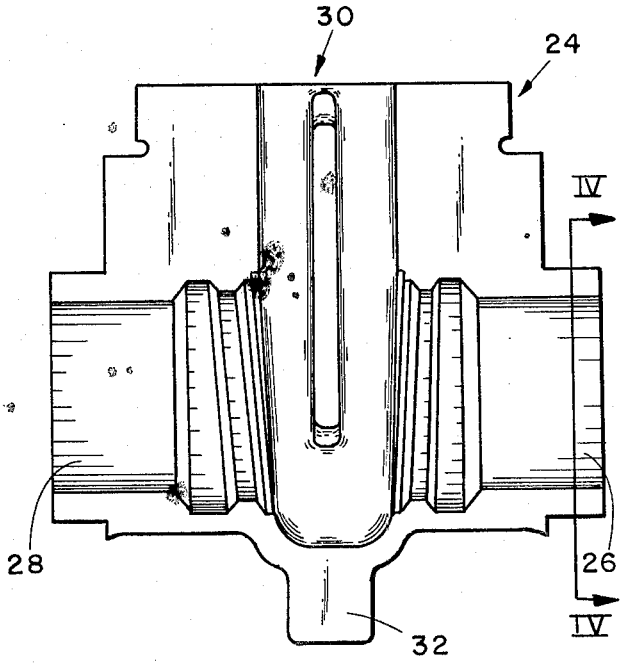
FIG. 2 is a front, elevational view of one element of a vaporizable pattern for a valve body.

The pattern 18 illustrated is of a type usable for casting of a gate valve body. As seen in FIGS. 2 and 3, the pattern 18 is preferably assembled from a plurality of separate pieces. Piece 24 corresponds to a longitudinal half of the cast valve body and defines inlet and outlet bores 26, 28 and a center recess half 30. It is presently preferred that the pattern half 24 be precision molded in an aluminum mold which corresponds to a longitudinal half of the valve body casting. The pattern piece 24 is dimensioned to account for normal shrinkage of the metal during the casting process and is molded with a sprue 32. A mirror image or second valve body half is fabricated in the same manner as the valve body half 24 illustrated in FIG. 2. It is preferred that the valve body halves be molded from a cellular expanded plastic material such as polystyrene or polyurethane.

As seen in FIG. 3, a vaporizable pattern for a connecting flange for the valve body is also preferably molded as a separate piece. The pattern piece 34 includes a central opening 36 having a diameter corresponding to the outer diameter of the bores of the valve body halves. The piece 34 is also formed with a plurality of mounting holes or apertures 38.

The pattern 18 is assembled by placing the mirror image valve body halves together and slipping the flange pieces 34 over the ends of the pattern. Reference means are preferably provided to insure concentric alignment of the flange mounting holes. For example, the patterns for the valve body halves and the flanges may be keyed so that the mounting holes 38 will be concentric with respect to each other. In the alternative, a witness line may be molded on the flange piece 34. The witness line may then be aligned with the parting line of the joined valve body pieces. This will insure that the mounting holes are reasonably concentric in the completed casting.

Fabricating the pattern from a plurality of pieces is especially advantageous in the context of valve body manufacture. A plurality of standard size flange pattern pieces may be fabricated and used interchangeably with a plurality of different valve body configurations. For example, the same size flange patterns could be used interchangeably with a gate valve body pattern or with a check valve body pattern.

Figure 4:
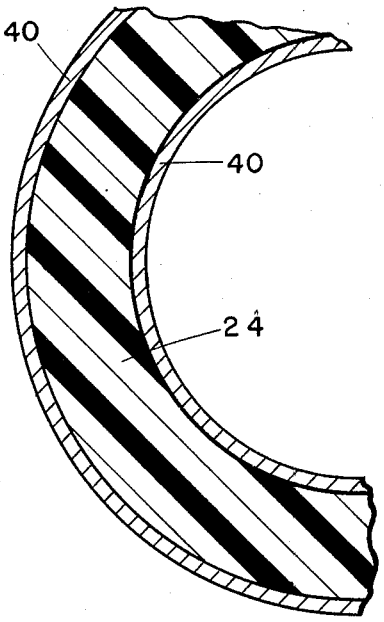
FIG. 4 is a fragmentary, cross-sectional view taken generally along line IV—IV of FIG. 2 showing the pattern after coating.

In order to prevent burning of the sand into the molten metal during the casting process and in order to obtain a high quality surface appearance for the completed casting, the assembled vaporizable pattern is coated with a liquid refractory material 40. The refractory coating 40, as seen in FIG. 4, covers the exterior and interior of the vaporizable pattern. The pattern may be dipped into the liquid material by suspending it from the sprue 32 or the coating may be sprayed onto the pattern.

Heretofore, the refractory coatings employed with the type of casting process under consideration have not been adequate. The coatings, while permitting "breathing" so as to allow the gases which result from the combustion or vaporization of the polystyrene pattern to pass therethrough into the sand, have not adequately prevented cross migration of the sand and the molten metal. Also, the prior refractory coatings have not been sufficiently rigid so as to permit handling of the pattern without cracking and so as to adequately support the pattern within the mold forming sand 16. The coating 40 must not break down when exposed to the metal charge at the extreme foundry temperatures and must continue to provide geometric stability for the sand around the pattern until the casting operation is complete. Further, the coating must be chemically inert at the temperature of the metal charge, non-reactive with the pattern and non-adherent to the metal charge.

The coating 40 employed in the present invention is a magnesium silicate or talc ceramic coating composition. The magnesium silicate or talc possesses excellent sintering and strength properties even though containing water of hydration. The water comes off at a temperature lower than that of the hot steel or metal poured into the mold. The release of the water of hydration does not, however, result in mechanical disruptions in the coating. Previously used coatings, for example, those having an aluminum oxide base, have possessed insufficient strength properties and/or have not been permeable enough to the gases generated by vaporization of the styrofoam pattern. The presently preferred composition of the mixture for coating 40 by weight is as follows: 26% asbestos free talc (Magnesium Silicate); 0.4% carboxylated styrene-butadiene latex; 0.04% Germantown or equivalent pigment grade lamp black; 6% denatured ethyl or isopropyl alcohol; and approximately 67% water.

It is presently preferred that a high purity, platy talc pigment which is free of asbestos-type impurities be employed. One such talc pigment is sold by Cyprus Industrial Minerals Company of Los Angeles, Calif., under the brand name Yellowstone Talc #200. The talc is the refractory component of the coating composition and provides good mixing, suspending and "painting" properties. Such properties are not typically obtained from other refractory materials without the addition of thickening, dispersing and wetting agents.

The latex acts as a binder. It is presently preferred that a latex sold under the brand name Dow Latex 211 by Dow Chemical Company, Midland, Mich., be employed. The latex binder causes the coating to properly adhere to the styrofoam pattern. Also, the binder causes the coating to have adequate film strength. The concentration ratio of the binder to the talc should be maintained within a relatively specific range. The percent of the latex binder by weight of the total mix can range from about 0.1% to 1.0%. Varying the percentage of the binder by weight to increase the permeability decreases the coating strength of the ceramic material. The permeability and coating strength qualities have been found to be best at approximately $0.4 \pm 0.1\%$.

The lamp black is added to the ceramic coating in order to give the coating a gray color. This coloring of the composition increases the ease by which the composition may be applied to the styrofoam. The gray color makes it easier to see the thickness of the coating when applied and to insure uniformity in application. A small amount of wetting agent, such as a dishwashing liquid or other liquid cleaners, may be used to prewet the dry lamp black for mixing in the ceramic composition.

The denatured ethyl or isopropyl alcohol which is available from any commercial distributor is employed to increase the speed of air drying of the coating after application to the pattern. The range of alcohol percentage by weight of the total mixture may vary from approximately 0.5% to 10%. Increasing the amount of alcohol above 10% may result in agglomeration of the latex in the mix.

The water serves as the main vehicle for the coating. The other components discussed above are dispersed in the water and little or no dissolved material is present. Adjustment of the water concentration controls the application properties of the liquid ceramic. The mixture may be applied by dipping the pattern, brushing the mixture onto the pattern or spraying the pattern either with an air spray or an airless spray and either as a hot or cold mixture. The concentration range of the water can be varied over a significant range. It is important, however, that the mix be applied as a fairly smooth coating. A Zahn Cup viscosity test may be employed to control viscosity in the same manner as such a test is used to control the viscosity of latex paints.

The talc based ceramic coating composition which employs the latex binder is relatively inexpensive to manufacture and easy to use when compared to prior refractory coatings which have been employed in this type of casting process. Prior commercial ceramic mold washes are too refractory at high temperatures and do not permit the gases generated during the process to escape therethrough and into the sand.

The coating possesses a combination of important characteristics which have not heretofore been found in any products tested over an extended period of experimentation. The magnesium silicate or talc based coating is gas permeable and permits escape of the gases created when the pattern is vaporized. The talc based coating possesses adequate refractory characteristics to withstand the foundry temperatures experienced without breaking down. Typically, in the casting of steel, the metal charge will have a temperature of approximately 2850° F. when poured into the mold. The coating serves as a boundary between the sand and the vaporizable pattern and provides the required geometric stability for the sand at the sand/metal boundary. The material is chemically inert at foundry metal temperatures and does not react with the molten metal or with the pattern pieces. The coating does not adhere to or become incorporated into the metal charge and possesses refractory qualities at foundry temperatures without cracking or causing corrosion. Further, the material will air dry on the pattern.

The talc based coating is applied to the pattern to a thickness of approximately 1/32 inch. The assembled pattern after coating is permitted to air dry and then placed within the sand 16. The sand is preferably a dry foundry sand of approximately 25 mesh. The flask is vibrated so that the sand packs tightly around and is the sole support for the metal charge as it is poured into the mold through the sprue 20. A wide variety of silica sands have been successfully used in the process as the back-up or mold forming material. The particular choice of sand is dependent upon the type of casting being produced. Angular sands lock up tighter and have more holding stability than round grain sands. However, round grain sands are capable of adequately filling intricate casting shapes when packed by vibration. Therefore, the type of dry sand employed is dependent upon the intricacy of the part to be cast. It is believed that the back-up material could be other than silica sand so long as it is of proper grain size and distribution to fill the flask and the intricate casting shapes and is resistant to the temperature of the metal to be cast.

It is presently preferred that a screen 44 of very fine mesh be placed adjacent the inside surfaces of the wall 12. The mesh screen 44 prevents the fine grain, dry sand from passing out through a plurality of apertures 46 formed in the wall. The apertures 46 are provided to permit rapid escape of the gases resulting from combustion of the pattern and which pass through the dry sand 16. It is presently preferred that the sprue 20 be in the shape of a hollow tapered cylinder. Also, it may be desirable to start the polystyrene burn out prior to actual casting in order to allow a pouring rate to be established resulting in a more uniform metal pour.

Once the coated pattern 18 is disposed within the sand 16 and the sand is adequately packed around the exterior and interior of the pattern, the molten charge is poured into the sprue 20 and contacts the vaporizable pattern at the sprue 32 of the pattern. The molten charge is supported by the sand 16 and combusts and vaporizes the pattern pieces. After sufficient metal has been poured into the sprue 20, the casting is permitted to cool and then removed from the mold.

Employing the talc based coating in the process in accordance with the present invention represents a significant advance over prior processes. Heretofore, the prior refractory coatings have been of the type typically supplied for lost wax or investment casting processes. These refractory coatings have not provided suitable results with respect to the surface quality of the completed cast piece. The improved process in accordance with the present invention permits the relatively inexpensive casting of high alloyed steels which are not economically forged and/or machined. The process may also be employed to provide improved castings of iron and non-ferrous metals such as brass.

In view of the foregoing description, various modifications to the preferred embodiment will undoubtedly become apparent to those of ordinary skill in the art. For example, other metal transport or gating systems than the lined sprue 20 could be employed. The process readily adapts to a wide variety of gating systems resulting in improved net yield of useful metal versus melted and poured metal than has heretofore been obtained. Also, as discussed above, multi-piece patterns for the fabrication of a wide variety of cast metal items may be employed in the present invention. Therefore, it is expressly intended that the above description should be considered as that of the preferred embodiment only. The true spirit and scope of the present invention will be determined by reference to the appended claims.

The embodiments of the invention in which an exclusive property or privilege is claimed are defined as follows:

1. An improved process for casting valve bodies and the like, said process being of the type including the steps of fabricating a pattern from cellular plastic material, imbedding the pattern in dry sand within a box, said box being of the type having perforated side walls, connecting a sprue to the pattern, and pouring a metal charge into the sprue, the improvement comprising:

coating said pattern with a talc based ceramic coating for permitting the escape of gases upon vaporization of the pattern into the sand and preventing burn in of the sand into the metal charge, said coating releasing water of hydration during the casting process and having adequate refractory characteristics to withstand exposure to the metal charge without breaking down and providing geometric stability for the sand around the coated pattern, said coating further being chemically inert at the temperature of the metal charge, non-reactive with the pattern, non-adherent to the metal charge and being capable of air drying without cracking after application to the pattern.

2. An improved process as defined by claim 1 wherein said pattern is fabricated from a plurality of separate pieces and subsequently assembled.

3. An improved process as defined by claim 2 wherein said imbedding step includes the step of vibrating the box to insure that the sand is packed around the pattern.

4. An improved process as defined by claim 2 wherein said sand is a fine mesh, angular foundry sand.

5. An improved process as defined by claim 4 wherein said coating step includes the step of dipping said pattern into a liquid bath of the talc based ceramic coating.

6. An improved process for casting valve bodies and the like, said process being of the type including the steps of fabricating a pattern from cellular plastic material, imbedding the pattern in dry sand within a box, said box being of the type having perforated side walls, connecting a sprue to the pattern, and pouring a metal charge into the sprue, the improvement comprising:

coating said pattern with a talc based ceramic coating for permitting the escape of gases upon vaporization of the pattern into the sand and preventing burn in of the sand into the metal charge, said coating having adequate refractory characteristics to withstand exposure to the metal charge without breaking down and providing geometric stability for the sand around the coated pattern, said coating further being chemically inert at the temperature of the metal charge, non-reactive with the pattern, non-adherent to the metal charge and being capable of air drying without cracking after application to the pattern, said pattern being fabricated from a plurality of separate pieces and subsequently assembled, said sand being a fine mesh, angular foundry sand, and wherein said talc based ceramic coating by weight of the total mixture consists essentially of: 26% talc; 0.1% to 1.0% carboxylated styrene-butadiene latex; 0.04% lamp black; 0.5% to 10% alcohol; and the remainder being water.

7. An improved process as defined by claim 6 wherein the pattern is coated to a thickness of approximately 1/32 inch.

8. An improved process for casting a valve body, said process being of the type including the steps of forming a vaporizable pattern, coating the pattern with a refractoy coating, imbedding the coated pattern in a dry sand within a flask, connecting a sprue to the pattern and pouring a metal charge into the sprue, the improvement comprising said step of forming said pattern including the steps of:

precision molding a first pattern piece corresponding to one longitudinal half of the valve body to be cast;

precision molding a second pattern piece corresponding to the other longitudinal half of the valve body;

precision molding a pair of annular flange pieces having a plurality of mounting holes therein;

assembling the pattern by placing said first and second pieces together and slipping a flange piece onto each end of said first and second pieces, said flange pieces including reference means for concentrically aligning the mounting holes of said flange piece and wherein said coating step includes coating said pattern with a talc based ceramic coating having water of hydration for permitting the escape of gases into the sand upon vaporization of the pattern and preventing burn in of the sand into the metal charge, said coating having adequate refractory characteristics to withstand exposure to the metal charge without breaking down and providing geometric stability for the sand around the coated pattern as the pattern is vaporized, said coating further being chemically inert at the temperature of the metal charge, non-reactive with the pattern, non-adherent to the metal charge and being capable of air drying without cracking after application to the pattern.

9. An improved process for casting a valve body, said process being of the type including the steps of forming a vaporizalbe pattern, coating the pattern with a refractory coating, imbedding the coated pattern in a dry sand within a flask, connecting a sprue to the pattern and pouring a metal charge into the sprue, the improvement comprising said step of forming said pattern including the steps of:

precision molding a first pattern piece corresponding to one longitudinal half of the valve body to be cast;

precision molding a second pattern piece corresponding to the other longitudinal half of the valve body;

precision molding a pair of annular flange pieces having a plurality of mounting holes therein; and assembling the pattern by placing said first and second pieces together and slipping a flange piece onto each end of said first and second pieces, said flange pieces including reference means for concentrically aligning the mounting holes of said flange piece, said coating step including coating said assembled pattern with a talc based composition by weight percent consisting essentially of: 26% asbestos free talc; 0.1% to 1.0% carboxylated styrene-butadine latex; 0.04% lamp black; 0.5% to 10% alcohol; and the remainder being water.

10. An improved process for casting hollow bodies of complex configuration, said process being of the type including the steps of fabricating a pattern from low density cellular plastic material, imbedding the pattern in dry sand within a box, said box being of the type having gas permeable side walls, providing means for introducing a molten metal charge into an area occupied by the pattern, the improvement comprising:

coating said pattern with a talc based ceramic coating having water of hydration for permitting the escape of gases into the sand upon vaporization of the pattern and preventing burn in of the sand into the metal charge, said coating having adequate refractory characteristics to withstand exposure to the metal charge without breaking down and providing geometric stability for the sand around the coated pattern as the pattern is vaporized, said coating further being chemically inert at the temperature of the metal charge, non-reactive with the pattern, non-adherent to the metal charge and being capable of air drying without cracking after application to the pattern.

11. The process of preparing a mold for the casting of hollow bodies of complex configuration, comprising the steps of preparing a pattern of low density cellular plastic material; preparing a coating consisting essentially of 26% talc; 0.1% to 1.0% carboxylated styrene-butadiene latex; 0.04% lamp black and 0.5% to 10% alcohol and the balance water; covering the surfaces of said pattern with said coating; drying said coating to a hard gas permeable film; imbedding said coated pattern in a matrix of supporting sand of a density such that it is gas permeable.

12. The process of preparing a mold for the casting of hollow bodies of complex configuration, comprising the steps of preparing a pattern of low density cellular plastic material; preparing a coating consisting essentially of 26% talc; 0.1% to 1.0% carboxylated styrene-butadiene latex; 0.5% to 10% alcohol; sufficient lamp black to provide a color contrast with white, and the balance water; covering the surfaces of said pattern with said coating; drying said coating to a hard gas permeable film; imbedding said coated pattern in a matrix of supporting sand of a density such that it is gas permeable.

* * * * *